United States Patent [19]

Kitchen et al.

[11] 4,163,296

[45] Aug. 7, 1979

[54] MATTRESS FOUNDATION EMPLOYING SPRINGS AND COOPERATING FOAM BODIES

[75] Inventors: John P. Kitchen, Georgetown; David W. Samuels, Lexington, both of Ky.

[73] Assignee: Hoover Universal, Inc., Saline, Mich.

[21] Appl. No.: 875,203

[22] Filed: Feb. 6, 1978

[51] Int. Cl.[2] ..... A47C 23/03

[52] U.S. Cl. ..... 5/255; 5/264 R; 5/400

[58] Field of Search ..... 5/247, 255, 264 R, 264 B, 5/267, 309, 351

[56] References Cited

U.S. PATENT DOCUMENTS

| | | | |
|---|---|---|---|
| 3,935,605 | 2/1976 | Hutchinson | 5/351 |
| 3,938,204 | 2/1976 | Slominski | 5/351 |
| 4,068,329 | 1/1978 | Gross et al. | 5/255 |

*Primary Examiner*—Casmir A. Nunberg

*Attorney, Agent, or Firm*—Olsen and Stephenson

[57] ABSTRACT

A box spring assembly having a rectangular horizontal frame, a wire grid displaced vertically above the frame and yieldably supported thereon, transverse cross rails secured to the frame and foam bodies on the cross rails and supporting the wire grid for providing yieldable resistance to downwardly directed loads placed on the grid. Each cross rail has a pair of horizontal end portions, a vertically displaced horizontal support portion and connecting portions extending between the end and horizontal support portions. The cross rails have generally inverted U-shaped cross sections and at least the horizontal support portions of the rails are embedded in the undersides of the foam bodies. The wire grid includes a network of criss-cross wires with torsion bar spring end and edge portions supporting the grid on the frame.

5 Claims, 5 Drawing Figures

MATTRESS FOUNDATION EMPLOYING SPRINGS AND COOPERATING FOAM BODIES

BACKGROUND OF THE INVENTION

The present invention relates to box spring assemblies using formed wire springs to support a mattress which are becoming increasingly desirably as an alternative to conventional coil spring box spring assemblies. Box spring assemblies of this type are illustrated in U.S. Pat. Nos. 3,286,281; 3,487,480; 3,574,241; 3,665,529; and 3,852,838, all of which are assigned to the assignee of the present invention.

It has always been desirable in the box spring industry to minimize expense and manufacturing difficulties in a box spring assembly while maximizing durability and uniformity of firmness.

The object of the present invention, therefore, is to provide an improved box spring assembly which accomplishes these objectives.

SUMMARY OF THE INVENTION

The present invention provides a box spring assembly that has a generally rectangular horizontal frame, a wire grid having torsion bar spring end portions supported on the frame, transverse cross rails secured to the frame and foam support bodies located between the cross rails and the grid. The foam bodies are formed of a resilient high density foam material, such as polyurethane or the equivalent, capable of providing adequate resistance to downwardly directed loads. The grid includes transverse and longitudinal wires and a plurality of intermediate support wires extending diagonally across the spaces between pairs of adjacent longitudinal and transverse wires.

The improved cross rails of this invention have a generally inverted U-shaped cross section and each rail has a pair of horizontal end portions secured to the frame, a vertically displaced horizontal support portion and a pair of connecting portions extending between the end and horizontal support portions.

The inclusion of the foam support bodies in this invention provides an effective means for uniformly yieldably supporting bedding loads while reducing wire requirements. This results in greater uniformity of load support across the present box spring assembly and increased durability due to the reduced use of wire. The foam bodies can readily be formed to various degrees of firmness to facilitate varying customer desires.

Further objects, features, and advantages of the invention will become apparent from a consideration of the following description, the appended claims, and the accompanying drawings in which:

Figure 1:
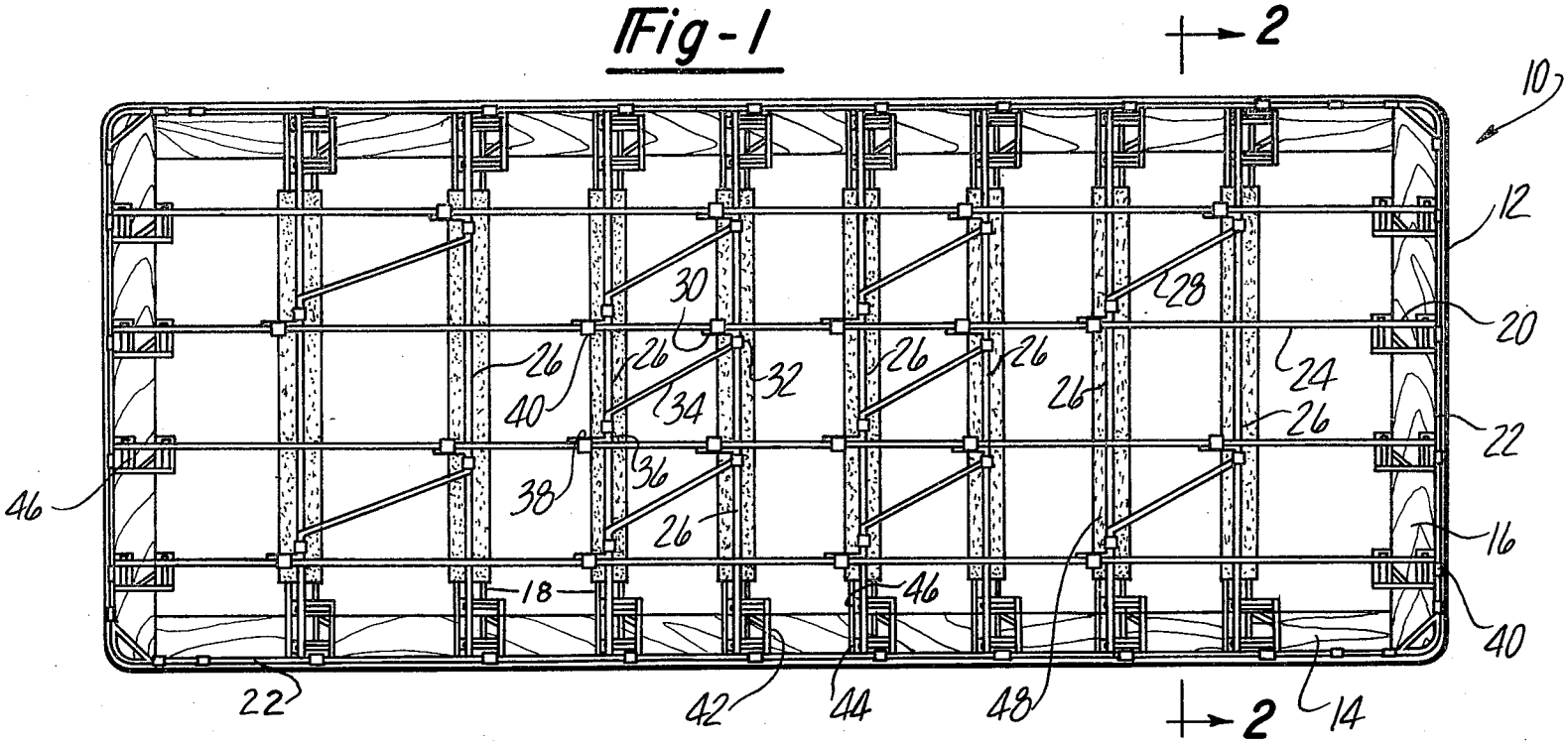
FIG. 1 is a plan view of the box spring assembly of this invention.

With reference to the drawing, the box spring assembly of this invention, indicated generally at 10, is illustrated in FIG. 1 as including a frame 12 having side rails 14 and end rails 16 secured together in a generally rectangular horizontal arrangement. A plurality of cross rails 18 (FIG. 2), spaced apart in a direction lengthwise of the frame 12, extend between the side rails 14 and are secured thereto by conventional staples (not shown) that extend through the ends of the cross rails 18 and project into the side rails 14. A horizontally disposed wire grid 20 is yieldably mounted on the frame 12 in a spaced relation therewith and has a perimeter defined by a border wire 22 which is consistent with the perimeter of the frame 12. The grid 20 includes a plurality of spaced longitudinal wires 24 which are substantially parallel to the side rails 14 and are secured to the border wire 22 and a plurality of spaced transverse wires 26 which are substantially parallel to the end rails 16 and are also secured to the border wire 22.

A plurality of intermediate wires 28, ten being illustrated in FIG. 1, extend diagonally across rectangular spaces enclosed by adjacent pairs of longitudinal wires 24 and transverse wire 26. Each of the wires 28 has a longitudinal portion 30 secured to a longitudinal wire 24, a transverse portion 32 secured to a transverse wire 26, a diagonal portion 34, a second transverse portion 36 secured to an adjacent transverse wire 26 and a second longitudinal portion 38 secured to an adjacent longitudinal wire 24.

A plurality of conventional clips 40 are provided on the grid 20 to secure adjacent side-by-side wire portions. A plurality of torsion bar spring end portions 42, integral with the grid wires 24 and 26, are mounted on the frame 12 so as to yieldably support the wire grid on the frame 12. The end portions 42 are described in detail in U.S. Pat. No. 3,574,241, and this detailed description is incorporated herein by reference. The spring end portions 42 have upper end torsion bars 44 (FIG. 2) secured to the grid 20 by means of the clips 40 and lower portions 46 secured in some cases to the cross rails 18 and in other cases directly to the frame 12. A foam body 48, of generally rectangular block form, is mounted on each of the cross rails 18 and disposed directly below the wire grid 20 providing further resistance to downwardly directed bedding loads at all significant load transfer points within the general boundaries of the border wire 22.

Figure 2:
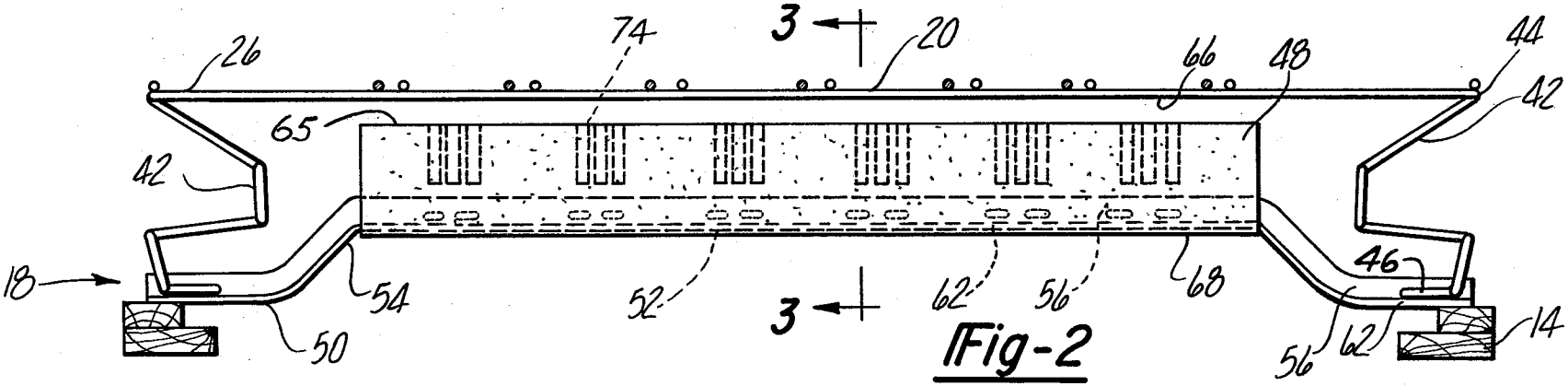
FIG. 2 is an enlarged transverse sectional view of the box spring assembly as seen from substantially the line 2—2 in FIG. 1.

With reference now to FIG. 2, it is seen that each of the cross rails 18 has a pair of horizontal end portions 50 secured to the side rails 14 by conventional staples, a horizontal support portion 52 vertically displaced above the end portions 50, and a pair of inclined connecting portions 54 extending between the end portions 50 and the horizontal support portions 52. Each cross rail 18 is of a generally inverted U-shape in cross section comprising a pair of upright leg sections 56 (FIG. 3), a horizontal support section 58 extending between the upper ends of the leg sections 56, a pair of outwardly extending horizontal flanges 60 at the lower ends of the leg sections 56 and a pair of upright flanges 62 at the outer ends of the horizontal flanges 60.

Figure 4:
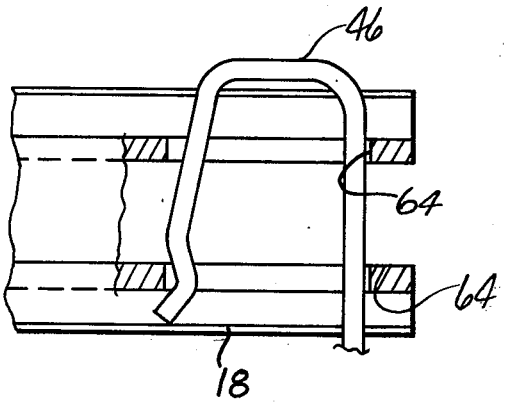
FIG. 4 is a fragmentary plan view of the end portion of a cross rail in the assembly of this invention showing a spring mounted thereon.

Pairs of horizontally spaced slots 64 (FIGS. 2 and 4) are provided in the leg sections 56. The lower portions 46 of the spring end portions 42 that are integral with the wires 24 are shaped as shown in U.S. Pat. No. 3,755,833 and are frictionally fitted in aligned pairs of the slots 64 as shown in FIG. 4 to secure the springs 42 to the cross rails 18 and thus to the frame 12. Each foam body 48 has a substantially flat top surface 65 located adjacent the underside 66 of the wire grid 20 and an underside 68 in which a cross rail 18 is embedded. FIG. 2 shows the horizontal support portion 52 of the cross rail 18 embedded in the body 48, but it is understood that the end and intermediate portions 50 and 54 or only part of the horizontal portion 52 could be embedded depending upon the extend of load support desired from the foam body 48 in a particular mattress foundation.

Figure 3:
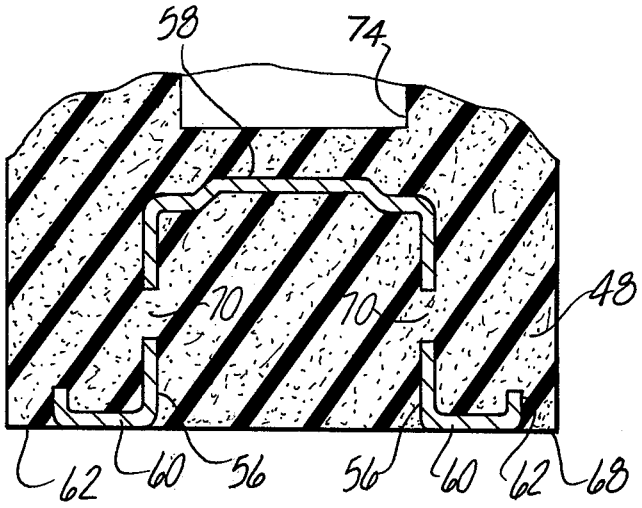
FIG. 3 is an enlarged transverse sectional view of one of the foam body and cross rail units in the box spring of this invention as seen from substantially the line 3—3 in FIG. 2.
Figure 5:
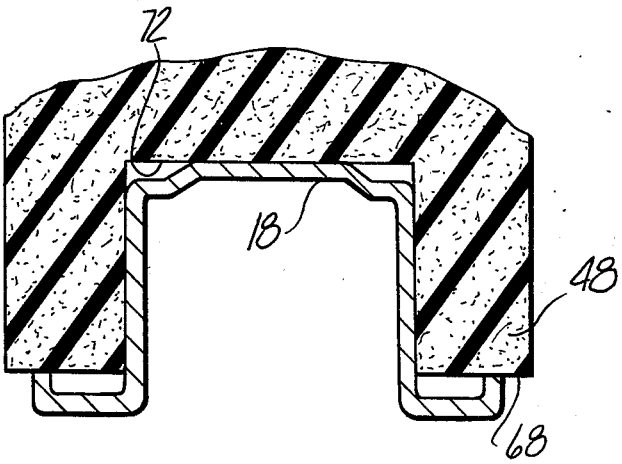
FIG. 5 is a sectional view like FIG. 3 showing another embodiment of the invention.

A rail 18 can be embedded in the body 48 by various methods, one of which results in the embodiment shown in FIG. 3 and another of which results in the embodiment shown in FIG. 5. The method of FIG. 3 involves foaming of the body 48 about the rail 18 so that the rail is substantially enclosed therein. Slots 70 are provided at spaced intervals along the rails 18 to facilitate bonding of the foam body to the rail 18. The method of FIG. 5 involves providing a channel 72 in the underside 68 of the foam body 48 and positioning the rail 18 in the channel 72. A suitable adhesive is applied to surfaces of the rail 18 which contact the foam body 48 to prevent slippage of the body 48 thereon.

From the above description it is seen that the present invention provides an improved box spring assembly 10 which optimizes the use of formed wire springs to provide continuous uniform support of bedding loads. The desired resistance to downwardly directed loads is provided at the perimeter of the box spring assembly 10 by torsion bar spring portions 42 and within the perimeter by the foam bodies 48 which engage the grid 20 and provide uniform support at every point at which the grid 20 engages the bodies 48 when the grid is subjected to bedding loads. This in turn provides desired bedding comfort. If desired the top surfaces 65 of the bodies 48 can be located to engage the grid 20 when the grid 20 is not loaded, as in FIG. 2. This provides a firmer foundation than when the surfaces 65 are spaced from the grid 20 as shown in FIG. 2. The firmness of the box spring assembly 10 is also easily varied without complicating the manufacturing process by altering the density or other characteristics of the foam bodies 48 or by forming vertically extending openings, such as those shown at 74 in FIGS. 2 and 3, in the bodies 48.

What is claimed:

1. In a box spring assembly having a generally rectangular horizontally disposed frame which includes side and end rails, a wire grid comprising a network of wires arranged in a horizontal plane disposed a predetermined distance above said frame, selected ones of said wires extending transversely of said frame, a plurality of spring end portions arranged in a supporting relation with said grid and supported on said frame, a plurality of transverse cross rails secured to and extending between said side rails, and foam means supported on said cross rails and underlying said grid so as to provide yieldable support for said grid on said cross rails when said grid is subjected to bedding loads, said foam means being located in general alignment with at least some of said transversely extending wires so as to be engaged thereby when a bedding load is applied to said grid.

2. A box spring assembly according to claim 1 wherein each of said cross rails has horizontal end portions secured to said side rails and an intermediate horizontal load supporting portion vertically displaced above said end portions and generally parallel thereto, and connecting portions extending between load supporting and end portions, at least said load supporting portion being arranged in a supporting relation with said foam means.

3. A box spring assembly according to claim 2 wherein each of said cross rails has a substantially inverted U-shaped cross section comprising a pair of horizontally spaced upright leg sections, a horizontal section extending between said leg sections at the upper portions thereof, and outwardly extending horizontal flange sections at the lower portions of said leg sections.

4. A box spring assembly according to claim 1 wherein said foam means comprises a plurality of elongated foam bodies corresponding to said cross rails, each of said bodies being supported on and extending longitudinally of a cross rail.

5. A box spring assembly according to claim 4, wherein each of said foam bodies is generally rectangular in cross section and each of said cross rails is of an inverted U-shape in cross section and is embedded in the underside of the corresponding foam body.

* * * * *